United States Patent [19]

Billings

[11] Patent Number: 4,805,514

[45] Date of Patent: Feb. 21, 1989

[54] DRUM MUFFLING, SOUND ENHANCING DEVICE

[76] Inventor: Christopher E. Billings, 496 Stewart St., Welch, W. Va. 24801

[21] Appl. No.: 44,574

[22] Filed: May 1, 1987

[51] Int. Cl.[4] ..... G10D 13/02

[52] U.S. Cl. ..... 84/411 M; 84/414

[58] Field of Search ..... 84/294–296, 84/410–411, 414

[56] References Cited

U.S. PATENT DOCUMENTS

| | | | |
|---|---|---|---|
| 548,982 | 10/1895 | van Gelder | 84/294 |
| 2,042,080 | 5/1936 | Turner | 84/296 |
| 2,285,269 | 6/1942 | Grolimund | 84/415 |
| 2,495,450 | 12/1946 | Gladstone | 84/411 |
| 2,499,616 | 12/1946 | Walberg | 84/411 |
| 3,026,759 | 3/1962 | Kleiner et al. | 84/411 R |
| 4,170,162 | 10/1979 | Casavant | 84/411 R X |
| 4,244,266 | 1/1981 | Hardy | 84/411 |
| 4,325,281 | 4/1982 | Hardy | 84/411 |

FOREIGN PATENT DOCUMENTS

| | | | |
|---|---|---|---|
| 1007596 | 4/1952 | France | 84/417 |
| 877229 | 6/1965 | U.S.S.R. | 84/411 |

*Primary Examiner*—Lawrence R. Franklin

[57] ABSTRACT

A device is provided for the attachment to the resonating membrane of a musical drum to overcome the ringing phenomenon associated with drum membranes fabricated of synthetic materials, and enhance the projected sound of the attack membrane. The device is comprised of a base portion and a ball portion. The base is attached to a circular opening cut into the resonating membrane and disposes the device within the drum with the larger distal end and directed toward the attack membrane. The device has an axis of symmetry which is vertically oriented to the resonating membrane. The internal periphery of the device, directed toward the axis, is fabricated of sound reflective material. The outside surface of the device is fabricated or porous sound absorbent material.

5 Claims, 3 Drawing Sheets

DRUM MUFFLING, SOUND ENHANCING DEVICE

BACKGROUND OF THE INVENTION

This invention relates to musical drum instruments, and more particularly concerns a device for the attachment to the drumhead that enhances the quality of the sound produced by the drum.

This invention concerns musical drums of the general type comprising a circular cylindrical sidewall shell supporting an upper or attack head and an opposed parallel lower or resonating head. The heads each consist of an outer rim associated with the shell and a drumhead membrane tauntly stretched upon the rim. The attack membrane has a preferred attack area centered therein. A plurality of tensioning devices are disposed upon the exterior surface of the shell to provide appropriate tension to the membranes.

Since the recent increased popularity of plastic and other synthetic drumheads, one of the most dominating considerations for drummers has become finding the most effective method of reducing or eliminating an undersirable phenomenon known as "drumhead ring". This phenomenon is characterized by distorted upper harmonic tonal over-rings that vary in pitch as successive impacts are applied to the attack drumhead, and when electric sound amplification systems are used to increase the volume of the drum, drumhead ring becomes significantly more noticeable.

One method of reducing this phenomenon is to place pillows, rugs or other materials inside the drum shell and in contact with the drumhead, but this method is unsightly, inconvenient, adversely affects the tonal quality of the drum and retards the projected sound volume of the percussion. There are also numerous commercial products available on today's consumer market, as disclosed in the U.S. Pat. Nos. 4,244,266 and 4,325,281, that effectively reduce these upper harmonic tonal over-rings, but the majority of drummers today only use these drumhead deadening devices and ring reducers on the tom-toms and snare drums. It is still a common practice to muffle the bass drums by placing pillows or rugs inside the drum shell against the attack drumhead. An opening is cut into the resonating drumhead to adjust the material within the drum shell and to place a microphone within, but the ringing phenomenon is still produced by the resonating drumhead and transferred to the microphone and through the amplification system.

OBJECTS AND ADVANTAGES

Therefore, one of the principle objects of the present invention is to eliminate the transference of this ringing phenomenon from the resonating drumhead to the microphone of a sound amplification system.

Another principle object of the present invention is to enhance the sound volume of the attack drumhead by capturing and concentrating the sound vibrations produced by the impact of a mallet or drumstick upon the attack drumhead, and directing these sound vibrations into a microphone or outward to the audience.

A further object of the present invention is to provide a device that can be used in combination with the drumhead deadening devices and ring reducers presently available on today's consumer market, thus entirely eliminating the need for and use of large bulky items, such as pillows and rugs, stuffed into the drum shell that "choke" the sound vibrations from the attack drumhead.

This device will be partially visible to the audience and a further object of the present invention is to provide a device that is more aesthetically appealing than an unembellished opening cut into the resonating membrane. To significantly broaden and expand the scope of this concept, the device can be manufactured in a variety of colors to give the drummer his or her option of contrasting colors or blends.

A still further object of the present invention is to provide a device that can be manufactured in a variety of sizes, can be manufactured at a price commensurate with market valuation, and in a manner that provides easy installation of said device.

These objects and other objects and advantages of the invention will be apparent upon consideration of the ensuing description and the accompanying drawings.

SUMMARY OF THE INVENTION

The above and other beneficial objects and advantages are accomplished in accordance with the present invention by a device disposed onto or within a circular opening cut into the center of the resonating membrane of a musical drum having an opposed attack membrane and a cylindrical shell, said device being comprised of a generally funnel-like bell portion terminating in a generally cylindrical, collar-like base portion emergent from said bell portion. The entire device has an open interior and both the base and bell portions are symmetrically disposed about an axis of symmetry. The base portion is attached to the opening in the resonating membrane in a manner to dispose the device within the drum with said axis of symmetry passing perpendicularly through the geometric center of the membrane.

The internal periphery of the device facing said axis of symmetry is fabricated of a smooth sound reflective material. The external portion of the device is fabricated of a porous sound absorptive material.

Porous materials useful in fabricating the external portion of the device include open and closed cell foams of resilient polymeric material such as polyethylene, polyurethane, neoprene, rubber, and equivalent materials. Suitable sound reflective materials for the internal periphery of the device include non-porous moldable plastics such as plasticized polyvinylchloride, rubber, silicones, polyurethanes, rubbery polymers made from butadiene, and equivalent materials. The base may be attached to the resonating membrane by adhesives or by mechanical means.

The device preferably has a unitary wall thickness, measured between inside and outside surfaces, of approximately ½ inch. Minor variations in the conformation of the bell portion may be employed within the criteria of the aforesaid limitations, with typical outlining variations being horn-like or polyhedral-like. In each shape, however, the distal extremity of the bell portion, which is directed toward the attack membrane, has a cross-sectional area no smaller than any regions of the smaller proximal portion.

BRIEF DESCRIPTION OF THE DRAWING

For a fuller understanding of the nature and objects of the invention, reference should be had to the following detailed description taken in connection with the accompanying drawings in which similar numerals of reference indicate corresponding parts in all the figures of the drawing.

DRAWING REFERENCE NUMERALS

Figure 1:
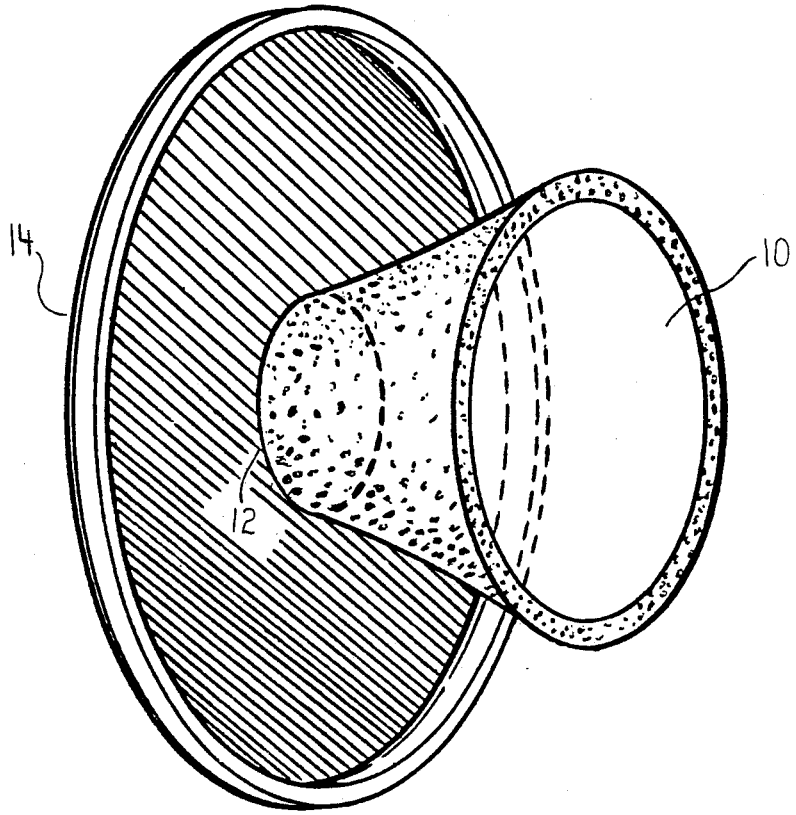
FIG. 1 is a perspective side view of an embodiment of the invention installed upon the internal side of a resonating drum membrane showing the funnel-like bell of said invention.

10 funnel-like bell
$10^1$ horn-like bell
$10^2$ polyhedral-like bell
12 necessary opening
14 resonating membrane
16 collar-like base
18 apertured membrane structure
20 adhesive layer
22 sidewall shell
24 attack membrane
26 retaining rims
28 tensioning devices
30 interior surface
32 exterior surface

DESCRIPTION OF PREFERRED EMBODIMENT

Referring more specifically to the drawings, and to FIG. 1, an embodiment of the funnel-like bell 10 of the invention is shown with the smaller proximal end disposed onto a circular opening 12 cut into the center of the resonating membrane 14.

Figure 2:
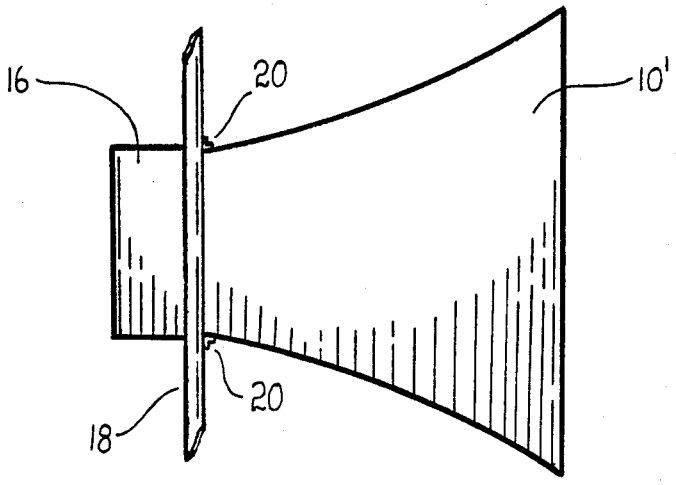
FIG. 2 is a side plan view of an embodiment of the invention showing the collar-like base emergent from the smaller proximal end of the bell, and the apertured membrane structure with an adhesive bonding for securing the invention to the resonating drum membrane.

FIG. 2 illustrates a side plan view of an embodiment of the invention showing the collar-like base 16 emergent from the smaller proximal end of the bell $10^1$, and the apertured membrane structure 18 with an adhesive layer 20 of contact cement or the like. The device can be held securely in place on the drum membrane by either the base abutting the apertured membrane structure 18 or a layer of adhesive 20 applied to said apertured membrane structure 18 and/or base 16.

Figure 3:
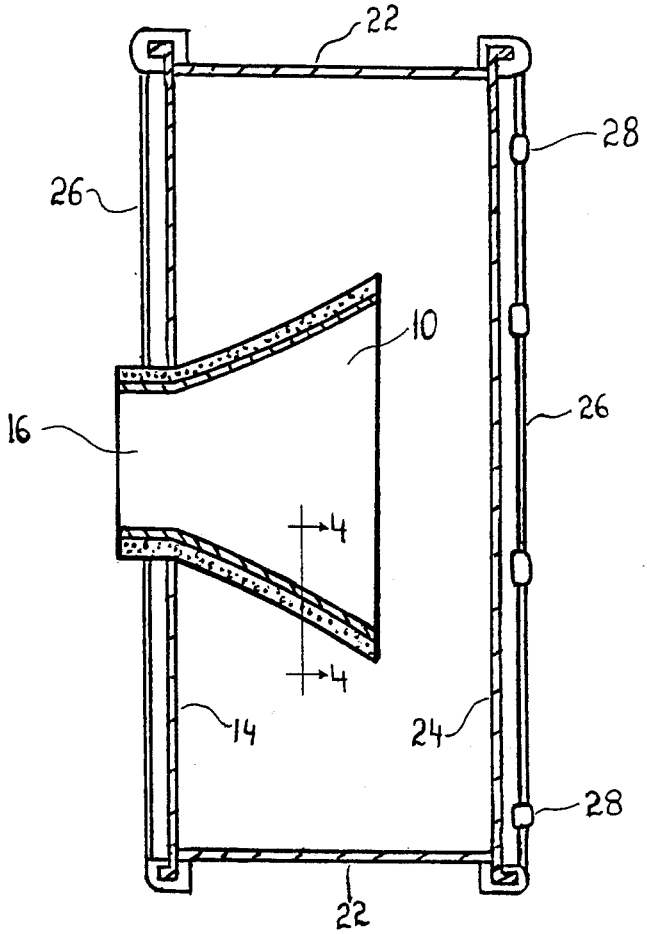
FIG. 3 is a vertical sectional view of a typical musical drum structure and an embodiment of the invention in operative installation upon the resonating membrane and within said musical drum structure.

FIG. 3 illustrates a vertical sectional view of a typical musical drum structure comprising a cylindrical sidewall shell 22, resonating and attack membranes, 14 and 24 respectively, paired retaining rims 26, and a plurality of tensioning devices 28 used to provide appropriate tension to the drum membranes. An embodiment of the invention is disposed within a circular opening 12 in the resonating membrane 14 and within the musical drum structure with the larger distal extremity directed toward the attack membrane 24. The collar-like base 16 is emergent from the bell 10 and extends sufficiently outward from the bell 10 and resonating membrane 14, not exceeding approximately 1½ to 2 inches in the largest size application, whereby to isolate the internal periphery of the device from the harmonic tonal overrings produced by the resonating membrane 14.

Figure 4:
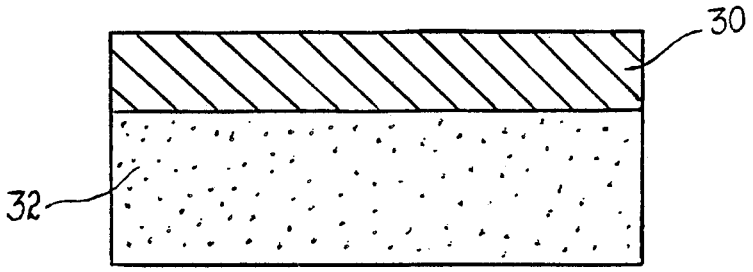
FIG. 4 is an enlarged fragmentary sectional view taken along the line 4—4 of FIG. 3.

FIG. 4 is an enlarged fragmentary sectional view of the materials comprising the interior and exterior surfaces, 30 and 32 respectively, of the invention. The interior surface 30 is fabricated of a smooth sound reflective material and the exterior surface 32 is fabricated of a porous sound absorptive material.

Figure 5:
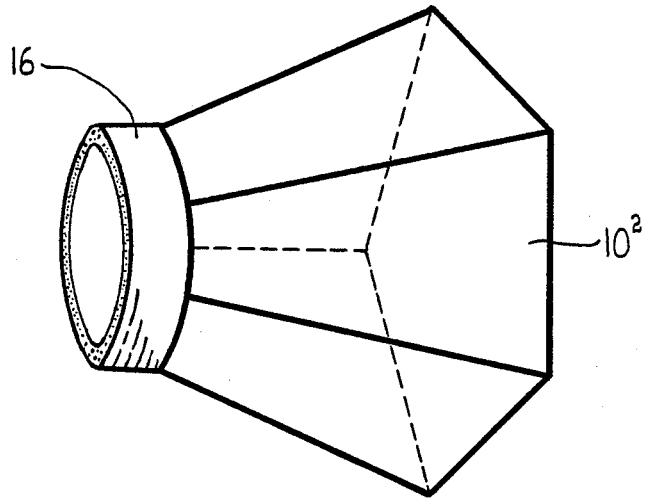
FIG. 5 illustrates an embodiment of the bell portion with the collar-like base emergent from the smaller proximal portion of the bell.

FIG. 5 illustrates a perspective side view of an embodiment of the invention showing the collar-like base 16 emergent from the smaller proximal portion of the bell $10^2$.

While the above description contains many specificities, the reader should not construe these as limitations on the scope of the invention, but merely as exemplifications of the preferred embodiments thereof. Those skilled in the art will envision many other possible variations are within its scope. Therefore it is requested the reader determine the true spirit of the invention and all possible modifications and variations as to: size, shape and color of the device; the materials used in construction of the device; the size drum structure the device is to be used on; the means by which the device is disposed and secured to the drum membrane; or whether the device be of an integral construction or a body having a plurality of segments; as none of these variations would depart from the original, conceptual scope of the invention. Accordingly, the aim of the appended claims is to cover all such changes and modifications as fall within the true spirit and scope of the invention.

I claim:

1. In a musical drum having resonating and attack membranes, a device comprising a generally funnel-like form or bell terminating in a generally cylindrical, collar-like form or base emergent from the smaller proximal portion of said bell, said device having an interior which is open along its entire axial length, and said device having a wall thickness of about ½ inch composed of moldable material, said device being disposed within said musical drum by abutment and attachment of said base within a circular opening cut into said resonating membrane with the larger distal extremity of said bell directed toward said attack membrane, whereby to capture, concentrate and direct outward the sound vibrations produced by the percussive impacts to said attack membrane.

2. A device as defined in claim 1 in which said bell's conformation is one of the following outlining forms: funnel-like, horn-like or polyhedral-like.

3. A device as defined in claim 1 in which said base is attached and adhered to said resonating membrane by an adhesive bonding applied to said base portion's abutment area.

4. A device as defined in claim 1 in which said wall's external surface is composed of a porous, resilient, polymeric material such as polyethylene, polyurethane, neoprene, rubber or similar sound absorptive material and the internal periphery of said wall is composed of a smooth, resilient, polymeric material such as polyvinyl chloride, rubber, silicones, polyurethane, rubbery polymers made from butadiene or similar sound reflective material.

5. A device as defined in claim 4 in which said wall is an integral construction.

* * * * *